US009367014B2

(12) United States Patent
Yamano et al.

(10) Patent No.: US 9,367,014 B2
(45) Date of Patent: Jun. 14, 2016

(54) IMAGE FORMING APPARATUS, IMAGE FORMING SYSTEM AND IMAGE FORMING METHOD

(71) Applicant: Konica Minolta Inc., Chiyoda-ku, Tokyo (JP)

(72) Inventors: Miho Yamano, Tokyo (JP); Hiroshi Matsumoto, Tokyo (JP); Kazunori Nishinoue, Tokyo (JP); Taizou Oonishi, Tokyo (JP); Atsushi Nakamura, Tokyo (JP); Makoto Fujii, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/499,767

(22) Filed: Sep. 29, 2014

(65) Prior Publication Data

US 2015/0093171 A1 Apr. 2, 2015

(30) Foreign Application Priority Data

Sep. 30, 2013 (JP) ..... 2013-204697

(51) Int. Cl.
*G03G 15/00* (2006.01)

(52) U.S. Cl.
CPC ..... *G03G 15/6552* (2013.01); *G03G 2215/007* (2013.01)

(58) Field of Classification Search
CPC ..... G03G 15/6555
USPC ..... 399/401
See application file for complete search history.

(56) References Cited

U.S. PATENT DOCUMENTS

| | | | | |
|---|---|---|---|---|
| 5,103,267 | A * | 4/1992 | Wada | G03G 15/234 399/20 |
| 5,132,742 | A * | 7/1992 | Goto | G03G 15/234 271/291 |
| 6,094,561 | A * | 7/2000 | Ushio | B65H 15/00 399/401 |
| 6,836,640 | B2 * | 12/2004 | Isemura et al. | 399/388 |
| 2002/0113357 | A1 * | 8/2002 | Seto et al. | 271/10.01 |
| 2009/0047051 | A1 * | 2/2009 | Suzaki | 399/401 |
| 2011/0088885 | A1 * | 4/2011 | Samuelson | F28D 1/05375 165/176 |
| 2013/0001851 | A1 * | 1/2013 | Kiriyama | 271/3.14 |

FOREIGN PATENT DOCUMENTS

| | | | |
|---|---|---|---|
| JP | 10181969 | A | 7/1998 |
| JP | 2004010240 | A | 1/2004 |

(Continued)

OTHER PUBLICATIONS

Japanese Notification of Reasons for Refusal corresponding to Patent Application No. 2013-204697; Dispatch Date: Aug. 19, 2015, with English translation.

*Primary Examiner* — Anthony Nguyen
(74) *Attorney, Agent, or Firm* — Cantor Colburn LLP

(57) ABSTRACT

An image forming apparatus has an image forming unit that forms an image on a sheet, a fixing unit that performs fixing of the sheet on which the image is formed, a first conveyance route that has a reverse conveyance route and a second conveyance route that does not pass the reverse conveyance route, and a control unit that performs first control for conveying a previously printed sheet which is printed previously via the first conveyance route and second control for conveying a subsequently printed sheet which is printed subsequently via the second conveyance route, and exerts control to feed the previously printed sheet and the subsequently printed sheet in an overlapped manner after the first conveyance route and the second conveyance route merge together.

22 Claims, 10 Drawing Sheets

(56) References Cited

FOREIGN PATENT DOCUMENTS

| | | | |
|---|---|---|---|
| JP | 2004059242 | A | 2/2004 |
| JP | 2007137536 | A | 6/2007 |
| JP | 2007168116 | A | 7/2007 |
| JP | 2007204239 | A | 8/2007 |
| JP | 2007279550 | A | 10/2007 |
| JP | 2012187875 | A | 10/2012 |

* cited by examiner

1

IMAGE FORMING APPARATUS, IMAGE FORMING SYSTEM AND IMAGE FORMING METHOD

CROSS-REFERENCE TO RELATED APPLICATIONS

The present application claims priority under 35 U.S.C. §119 to Japanese Patent Application No. 2013-204697, filed Sep. 30, 2013. The contents of this application are incorporated herein by reference in their entirety.

BACKGROUND OF THE INVENTION

1. Field of the Invention

The present invention relates to an image forming apparatus, an image forming system, and an image forming method.

2. Description of the Related Art

An electro photographic image forming apparatus forms a latent image on a photoreceptor based on image data and develops the latent image as a toner image. The developed toner image is transferred on a sheet through a transfer unit. The image forming apparatus of such a type as to temporarily transfer the toner image on an intermediate transfer unit, transfers the toner image on the intermediate transfer unit on a sheet through a transfer unit corresponding to a secondary transfer unit.

To reliably perform transfer, these transfer units perform transfer by attracting the negatively charged toner image by positively charging a back side of the sheet, to a front side of the sheet. Thereafter, a fixing device fixes the toner image on the sheet and ejects the sheet on which the toner image is fixed to a paper ejection tray.

Some of these image forming apparatuses have two modes of a sheet ejection mode in which a sheet on which a toner image is fixed is ejected without being reversed, and a sheet ejection mode in which a sheet is reversed and ejected (see, for example, Japanese Patent Laid-Open No. 2007-168116). These image forming apparatuses are configured to be able to switch over between the above-described sheet ejection modes for each job to facilitate job-basis segmentation.

In the above-described image forming apparatuses, because positive charge is given to the back side of the sheet during transfer of the toner image on the sheet as described above, the surface on which the toner image is formed is negatively charged after the transfer of the toner image, and the opposite surface to which positive charge is given is positively charged.

When the sheet charged as described above is ejected to the paper ejection tray, if the sheet is ejected in the same manner of faces as the previously ejected sheet, the positively charged face of the ejected sheet overlaps with the negatively charged face of the previously ejected sheet, which possibly causes problems that the sheets stick to each other or it is difficult to align the sheets. These problems become prominent when post-processing is performed on the sheets. These problems prominently occur, in particular, in prints in the field of PP (Production Printer).

The image forming apparatus of Japanese Patent Laid-Open No. 2007-168116 switches over between two modes of the sheet ejection mode in which the sheet is ejected without being reversed and the sheet ejection mode in which the sheet is reversed and ejected for each job. However, with this image forming apparatus, it is impossible to prevent sheets ejected in the same job from sticking to each other.

Further, in view of the above-described problems, there is a proposed image forming apparatus that eliminates charge of a sheet after image transfer using a charge eliminating blower (see Japanese Patent Laid-Open No. 10-181969). Further, there is a proposed image forming apparatus provided with a first charge eliminator and a second charge eliminator cause to reliably eliminate charges (see Japanese Patent Laid-Open No. 2004-10240). However, with these image forming apparatuses, it is difficult to ensure eliminating charge and it is still impossible to ensure preventing sheets from sticking to each other.

The present invention has been made in view of the above circumstances and has at least one object to provide an image forming apparatus, image forming system and image forming method, which prevent the sheets, which are charged, from sticking to each other.

SUMMARY OF THE INVENTION

To achieve at least one of the abovementioned objects, an image forming apparatus reflecting one aspect of the present invention includes:

an image forming unit that forms an image on a sheet;

a fixing unit that performs fixing of the sheet on which the image is formed;

a first conveyance route that has a reverse conveyance route, a second conveyance route that does not pass the reverse conveyance route, the first conveyance route and the second conveyance route diverging and merging in a course between the fixing and ejection; and a control unit that performs first control for conveying a previously printed sheet which is printed previously via the first conveyance route and second control for conveying a subsequently printed sheet which is printed subsequently via the second conveyance route, and that exerts control to feed the previously printed sheet and the subsequently printed sheet in an overlapped manner after the first conveyance route and the second conveyance route merge together.

In the image forming apparatus according to the above-mentioned aspect, it is preferable that the control unit performs the first control and the second control for sheets on both sides of which printing is performed.

In the image forming apparatus according to the above-mentioned aspect, it is preferable that the control unit exerts control to form images on the sheets fed in the overlapped manner by the first control and the second control while a front side image and a back side image of one of the sheets are reversed from those of the other sheet.

In the image forming apparatus according to the above-mentioned aspect, it is preferable that the control unit exerts control to convey a sheet solely in which printing is performed on one side by the first control or the second control.

In the image forming apparatus according to the above mentioned aspect, it is preferable that the previously printed sheet and the subsequently printed sheet are conveyed while the previously printed sheet partly or completely overlaps with the subsequently printed sheet when the first conveyance route and the second conveyance route merge together.

In the image forming apparatus according to the above-mentioned aspect, it is preferable that the control unit exerts control to feed the previously printed sheet and the subsequently printed sheet in the overlapped manner so that an overlap area of the sheets is 90% or more.

In the image forming apparatus according to the above-mentioned aspect, it is preferable that, when the previously printed sheet and the subsequently printed sheet are conveyed while the previously printed sheet partly overlaps with the subsequently printed sheet, the previously printed sheet and the subsequently printed sheet are aligned in a stack unit or a paper ejecting unit.

In the image forming apparatus according to the abovementioned aspect, it is preferable that, if number of output sheets is an odd number and when a last sheet is output, the control unit exerts control to convey the last sheet solely by performing the first control, without feeding the last sheet in the overlapped manner.

In the image forming apparatus according to the abovementioned aspect, it is preferable that the control unit makes a sheet linear speed in the first conveyance route variable and sets the sheet linear speed when the sheets are conveyed during the first control and the second control lower than a sheet linear speed when the sheets are conveyed only during the first control.

In the image forming apparatus according to the abovementioned aspect, it is preferable that the control unit exerts control to feed the sheets in the overlapped manner so that sides of the sheets facing each other are charged with same polarity.

In the image forming apparatus according to the abovementioned aspect, it is preferable that the control unit detects arrival of the previously printed sheet on the first conveyance route, and adjusts conveyance of the previously printed sheet and the subsequently printed sheet on the basis of detection so that the previously printed sheet and the subsequently printed sheet are fed in the overlapped manner when the first conveyance route and the second conveyance route merge together.

To achieve at least one of the abovementioned objects, an image forming system reflecting one aspect of the present invention includes:

an image forming unit that forms an image on a sheet;

a fixing unit that performs fixing of the sheet on which the image is formed;

a first conveyance route that has a reverse conveyance route and a second conveyance route that does not pass the reverse conveyance route, the first conveyance route and the second conveyance route diverging and merging in a course between the fixing and system ejection; and a control unit that performs first control for conveying a previously printed sheet which is printed previously via the first conveyance route and second control for conveying a subsequently printed sheet via the second conveyance route, and that exerts control to feed the previously printed sheet and the subsequently printed sheet in an overlapped manner after the first conveyance route and the second conveyance route merge together.

In the image forming system according to the abovementioned aspect, it is preferable that the control unit performs the first control and the second control for sheets on both sides of which printing is performed.

In the image forming system according to the abovementioned aspect, it is preferable that the control unit exerts control to form images on the sheets fed in the overlapped manner by the first control and the second control while a front side image and a back side image of one of the sheets are reversed from those of the other sheet.

In the image forming system according to the abovementioned aspect, it is preferable that the control unit exerts control to convey a sheet solely in which printing is performed on one side by the first control or the second control.

In the image forming system according to the abovementioned aspect, it is preferable that the previously printed sheet and the subsequently printed sheet are conveyed while the previously printed sheet partly or completely overlaps with the subsequently printed sheet when the first conveyance route and the second conveyance route merge together.

In the image forming system according to the abovementioned aspect, it is preferable that the control unit exerts control to feed the previously printed sheet and the subsequently printed sheet in the overlapped manner so that an overlap area of the sheets is 90% or more.

In the image forming system according to the abovementioned aspect, it is preferable that, when the previously printed sheet and the subsequently printed sheet are conveyed while the previously printed sheet partly overlaps with the subsequently printed sheet, the previously printed sheet and the subsequently printed sheet are aligned in a stack unit or a paper ejection tray.

In the image forming system according to the abovementioned aspect, it is preferable that, if number of output sheets is an odd number and when a last sheet is output, the control unit exerts control to convey the last sheet solely by performing the first control, without feeding the last sheet in the overlapped manner.

In the image forming system according to the abovementioned aspect, it is preferable that the control unit makes a sheet linear speed in the first conveyance route variable and sets the sheet linear speed when the sheets are conveyed during the first control and the second control lower than a sheet linear speed when the sheets are conveyed only during the first control.

In the image forming system according to the abovementioned aspect, it is preferable that the control unit exerts control to feed the sheets in the overlapped manner so that sides of the sheets facing each other are charged with same charge polarity.

In the image forming system according to the abovementioned aspect, it is preferable that the control unit detects arrival of the previously printed sheet on the first conveyance route, and adjusts conveyance of the previously printed sheet and the subsequently printed sheet on the basis of the detection so that the previously printed sheet and the subsequently printed sheet are fed in the overlapped manner when the first conveyance route and the second conveyance route merge together.

To achieve at least one of the abovementioned objects, an image forming method reflecting one aspect of the present invention is a method for forming an image on a sheet and conveying the sheet, the method including:

conveying a previously printed sheet which is printed previously via a first conveyance route having a reverse conveyance route;

conveying a subsequently printed sheet which is printed subsequently via a second conveyance route that does not pass the reverse conveyance route; and feeding the previously printed sheet and the subsequently printed sheet in an overlapped manner after the first conveyance route and the second conveyance route merge together.

DETAILED DESCRIPTION OF THE PREFERRED EMBODIMENT

An image forming apparatus according to one embodiment of the present invention will be explained below with reference to the accompanying drawings.

Figure 1:
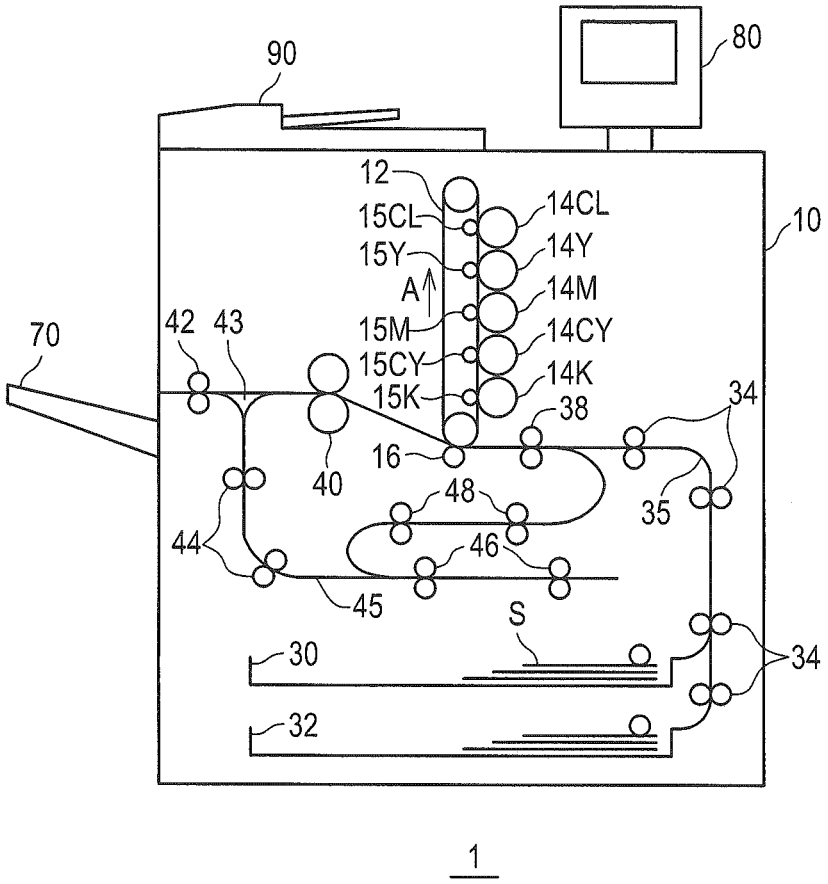
FIG. 1 illustrates a configuration of an image forming apparatus according to one embodiment of the present invention.

FIG. 1 illustrates a configuration of the image forming apparatus 1. The image forming apparatus 1 has a printer 10, an operation panel 80 and a document reading unit 90. The printer 10 prints an image on a sheet based on image data. The operation panel 80 receives operation from a user, concerning print start, selection of a print mode (such as a double-sided printing mode and a high-gloss mode), or the like. The document reading unit 90 reads a document and generates image data.

An intermediate transfer belt 12 is disposed at the center of the printer 10. The intermediate transfer belt 12 is rotationally driven in a direction of an arrow A illustrated in FIG., and a toner image formed on a photoreceptor drum surface is primarily transferred on the intermediate transfer belt 12. The toner image primarily transferred on the intermediate transfer belt 12 is secondarily transferred on a sheet S.

Five imaging units 14CL, 14Y, 14M, 14CY and 14K (hereinafter, abbreviated as 14) of clear (CL), yellow (Y), magenta (M), cyan (C) and black (K) are disposed at a side of the intermediate transfer belt 12 in this order from an upper part. Each imaging unit 14 has a photoreceptor drum which is not illustrated. Around each photoreceptor drum, a charging device for uniformly charging a surface of the photoreceptor drum, an exposing device for forming an electrostatic latent image according to the image data on the surface of the photoreceptor drum which is uniformly charged, and a developing device for developing the electrostatic latent image as a toner image (all of which are not illustrated) are disposed.

Further, primary transfer rollers 15CL, 15Y, 15M, 15CY and 15K (hereinafter, abbreviated as 15) are disposed at positions facing the photoreceptor drums over the intermediate transfer belt 12. The primary transfer roller 15 primarily transfers the toner image formed on the surfaces of the photoreceptor drums on the intermediate transfer belt 12 by electrostatically attracting the toner image.

A secondary transfer roller 16 is disposed below the intermediate transfer belt 12. The secondary transfer roller 16 secondarily transfers the toner image formed on the intermediate transfer belt 12 on a conveyed sheet S. During secondary transfer, the toner image which is negatively charged is electrostatically attracted to the sheet S by a high positive transfer voltage being applied to the secondary transfer roller 16.

At a downstream side of the secondary transfer roller 16, a fixing unit 40 for fixing the transferred toner image on the sheet S is disposed. At a further downstream side of fixing unit 40, a paper ejection roller 42 for ejecting the sheet S to the paper ejection tray 70 through a switching gate 43 is disposed. The paper ejection roller 42 and the paper ejection tray 70 configure a paper ejecting unit.

At a lower portion of the printer 10, paper feeding cassettes 30 and 32 which are configured in two stages are disposed so as to be able to be attached and removed. Further, a conveyance path 35 which leads to the paper ejection tray 70 from the paper feeding cassettes 30 and 32 via an intermediate conveyance roller 34, a resist roller 38, the secondary transfer roller 16, the fixing unit 40 and the paper ejection roller 42 is provided. The above-described rollers and the conveyance path 35 configure a non-reverse conveying unit. In this embodiment, the non-reverse conveying unit is configured with a straight conveying unit, and a conveying unit from an image forming unit toward a downstream side in a paper ejection direction is configured with the non-reverse conveying unit. The conveyance path 35 at a downstream side of the fixing unit configures a second conveyance route of the present invention which does not have a reverse conveyance route at a downstream side of the fixing unit 40.

Further, above the paper feeding cassettes 30 and 32, there is disposed a reverse conveyance path 45 which diverges from the conveyance path 35 via a switching gate 43 at a downstream side of the fixing unit 40 and merges with the conveyance path 35 immediately before the resist roller 38 positioned at an upstream side of the image forming unit in a sheet conveyance direction.

At a downstream side of the reverse conveyance path 45, an ADU reversing roller 46 and an ADU intermediate conveyance roller 48 for conveying the sheet S to a downstream side of the reverse conveyance path 45 while reversing a front and back faces of the sheet S are provided.

Further, at the reverse conveyance path 45 positioned immediately below the conveyance path 35 from the fixing unit 40 to the paper ejection roller 42, there is disposed a conveyance reversing roller 44 for conveying the sheet conveyed from the fixing unit 40 to a side of the paper ejection roller 42 while reversing front and back faces of the sheet, and part of the reverse conveyance path 45 merges with the conveyance path 35 at a downstream side. The conveyance reversing roller 44 and part of the reverse conveyance path 45 positioned near the conveyance reversing roller 44 in a paper conveyance direction configure a paper reversing unit. Part of the reverse conveyance path 45, which has the conveyance reversing roller 44 and which diverges from the conveyance path 35 and merges with the conveyance path 35 configure a first conveyance route of the present invention having the reverse conveyance route.

It should be noted that while, in this embodiment, part of the reverse conveyance path 45 in which the ADU conveying unit 160 is provided is also used as the first conveyance route, the first conveyance route is provided separately from the reverse conveyance path 45.

Figure 2:
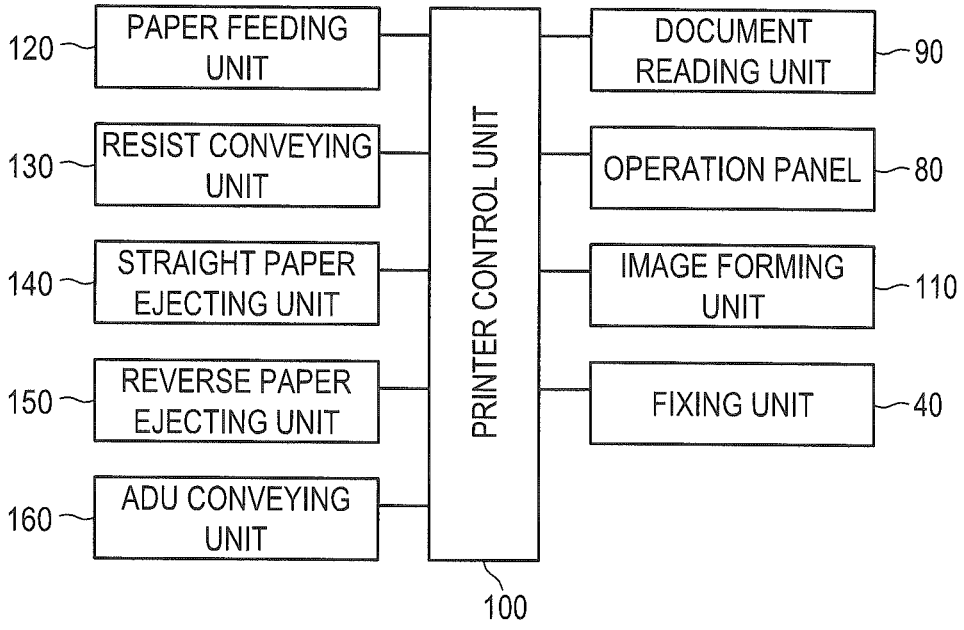
FIG. 2 is a control block diagram of the image forming apparatus.

A control block of the image forming apparatus 1 will be explained next based on FIG. 2.

A printer control unit 100 which controls the whole image forming apparatus, such as image formation on the sheet S and conveyance and ejection of the sheet S, is configured with a CPU, a program for activating the CPU, a ROM, a RAM, a non-volatile memory, and the like. The printer control unit 100 corresponds to a control unit of the present invention.

Further, the non-volatile memory which is not illustrated stores a paper conveyance or eject timing when sheets can be fed in an overlapped manner.

The document reading unit 90 is connected to the printer control unit 100 in a controllable manner. The document reading unit 90 reads an image of a document set in the document reading unit 90 and generates image data.

The operation panel 80 is connected to the printer control unit 100 in a controllable manner. The operation panel 80 receives operation from a user, concerning print start, setting of a print mode (such as a double-sided printing mode and a high-gloss mode), or the like. The details of the operation are transmitted to the printer control unit 100. It should be noted that whether or not to feed sheets in an overlapped manner can be set by the operation panel 80.

The image forming unit 110 is connected to the printer control unit 100 in a controllable manner. The image forming unit 110 forms a toner image on the photoreceptor drum based on the image data and primarily transfers the formed toner image on the intermediate transfer belt 12. The image forming unit 110 secondarily transfers the toner image on the intermediate transfer belt 12 on the sheet S conveyed on the secondary transfer roller 16.

The fixing unit 40 is connected to the printer control unit 100 in a controllable manner. The fixing unit 40 fixes the toner image transferred on the sheet S, on the sheet S through thermal dissolution.

A paper feeding unit 120 is connected to the printer control unit 100 in a controllable manner. The paper feeding unit 120 is a control unit for conveying the sheet S loaded and accommodated in the paper feeding cassettes 30 and 32 to the resist roller 38 using the intermediate conveyance roller 34.

A resist conveying unit 130 is connected to the printer control unit 100 in a controllable manner. The resist conveying unit 130 is a control unit for conveying the sheet S from the resist roller 38 to the fixing unit 40.

A straight paper ejecting unit 140 is connected to the printer control unit 100 in a controllable manner. The straight paper ejecting unit 140 is a control unit for ejecting the sheet S which has passed the fixing unit 40 to the paper ejection tray 70 by the paper ejection roller 42 without reversing front and back faces of the sheet. The straight paper ejecting unit 140 operates by the second control performed by the printer control unit 100.

A reverse paper ejecting unit 150 is connected to the printer control unit 100 in a controllable manner. The reverse paper ejecting unit 150 is a control unit for ejecting the sheet S which has passed the fixing unit 40 to the paper ejection tray 70 after reversing front and back faces of the sheet by the conveyance reversing roller 44. The reverse paper ejecting unit 150 operates by the first control performed by the printer control unit 100.

The ADU conveying unit 160 is connected to the printer control unit 100 in a controllable manner. The ADU conveying unit 160 is a control unit for reversing the sheet S which has passed the fixing unit 40 using the conveyance reversing roller 44 and the ADU reversing roller 46 and conveying the sheet S to the resist roller 38 by the ADU intermediate conveyance roller 48.

Basic operation of the image forming apparatus 1 will be described below.

When a user performs operation to start printing from the operation panel 80, the document reading unit 90 reads the set document, and generates image data. The exposing device forms an electrostatic latent image on the surface of the photoreceptor drum which is uniformly charged, based on the generated image data. The formed electrostatic latent image is developed as a toner image by the developing device. The primary transfer roller 15 primarily transfers the toner image formed on the surface of the photoreceptor drum on the intermediate transfer belt 12 by electrostatically attracting the toner image. It should be noted that a method for acquiring image data is not limited to the above-described method, but can be a method in which image data is acquired through a network.

The sheet S loaded and accommodated in the paper feeding cassettes 30 and 32 is sent to the conveyance path 35 layer by layer by control of the paper feeding unit 120 in response to the operation of print start, and the sheet S is conveyed to the resist roller 38 through the conveyance path 35 by the intermediate conveyance roller 34. The sheet S conveyed to the resist roller 38 is conveyed to a position where the sheet S contacts the secondary transfer roller 16 while achieving synchronization with the toner image on the intermediate transfer belt 12.

The toner image on the intermediate transfer belt 12 is secondarily transferred on the sheet S at a position of the secondary transfer roller 16. In the secondary transfer, the toner image which is negatively charged is transferred by electrostatically attracting the toner image to the sheet S from the intermediate transfer belt 12 by applying a high positive transfer voltage on the secondary transfer roller 16. The toner image transferred on the sheet S is conveyed through the conveyance path 35 and fixed on the sheet S at the fixing unit 40 through thermal diffusion. Subsequently, in a case of a single-sided printing mode, the sheet S passes the paper ejection roller 42 and is ejected to the paper ejection tray 70.

It should be noted that a mode of ejecting a sheet to the paper ejection tray 70 includes two types of a straight paper ejection mode and a reverse paper ejection mode. In the straight paper ejection mode, after an image is printed on the sheet S, the sheet S is ejected to the paper ejection tray 70 without reversing front and back faces of the sheet S. In the straight paper ejection mode, the sheet is ejected with the same side kept face-up. In the reverse paper ejection mode, after an image is printed on the sheet S, the sheet S is reversed front and back faces and ejected to the paper ejection tray 70.

Figure 3:
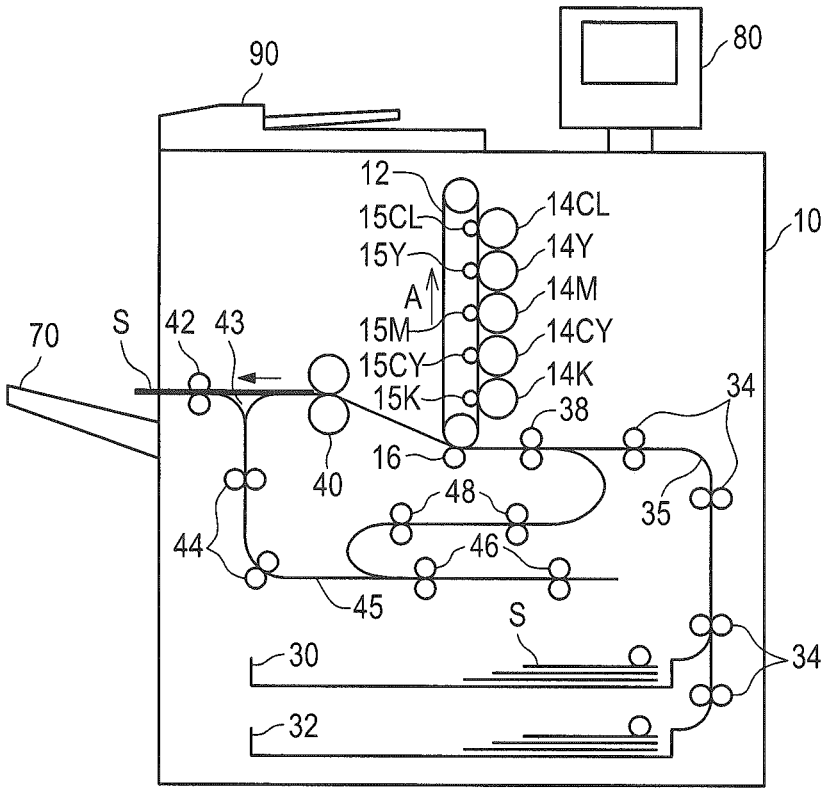
FIG. 3 illustrates operation when a sheet is ejected in a straight state in the image forming apparatus.

FIG. 3 illustrates sheet conveyance operation in the straight paper ejection mode. In the straight paper ejection mode, the sheet S which has passed the fixing unit 40 is ejected to the paper ejection tray 70 through the paper ejection roller 42 on the conveyance path 35 which is the first conveyance route, without being reversed, by control of the straight paper ejecting unit 140.

Figure 4:
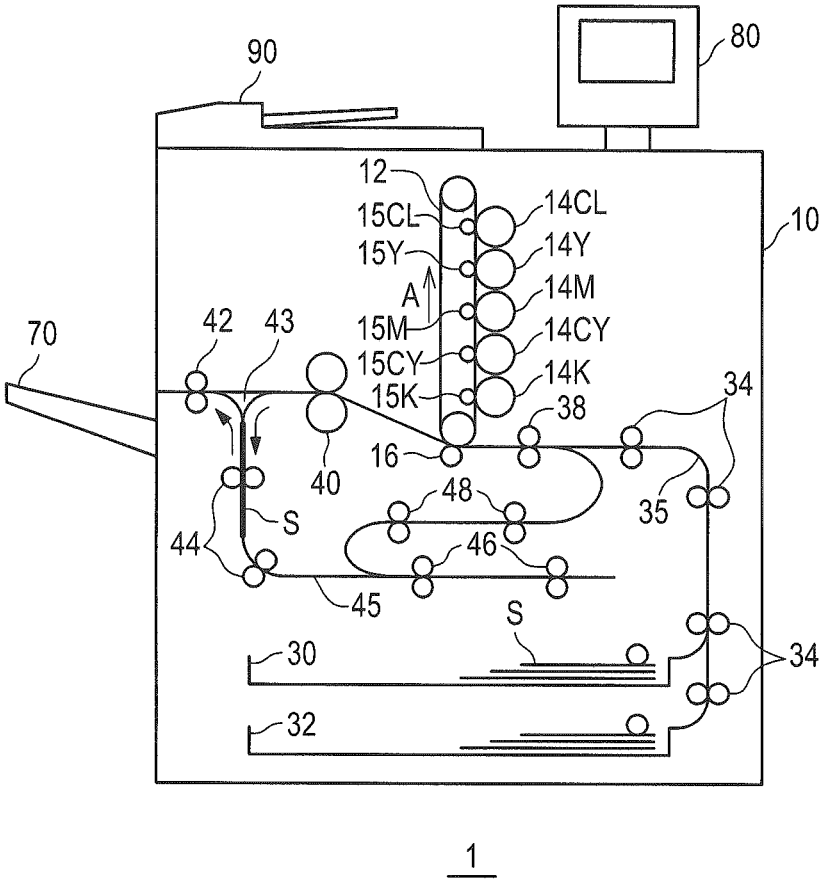
FIG. 4 illustrates operation when a sheet is reversed and ejected in the image forming apparatus.

FIG. 4 illustrates sheet conveyance operation in the reverse paper ejection mode. In the reverse paper ejection mode, the sheet S which has passed the fixing unit 40 is conveyed to a side of the conveyance reversing roller 44 by switching operation of the switching gate 43 by the control of the reverse paper ejecting unit 150. At this time, the conveyance reversing roller 44 is driven to rotate normally, thereby conveying the sheet S downward through the reverse conveyance path 45. Subsequently, the conveyance reversing roller 44 is driven to rotate reversely, thereby conveying the sheet S from the reverse conveyance path 45 to a side of the paper ejection roller 42. By this means, the sheet S is reversed front and back. The reversed sheet S is ejected to the paper ejection tray 70 through the paper ejection roller 42.

Figure 5:
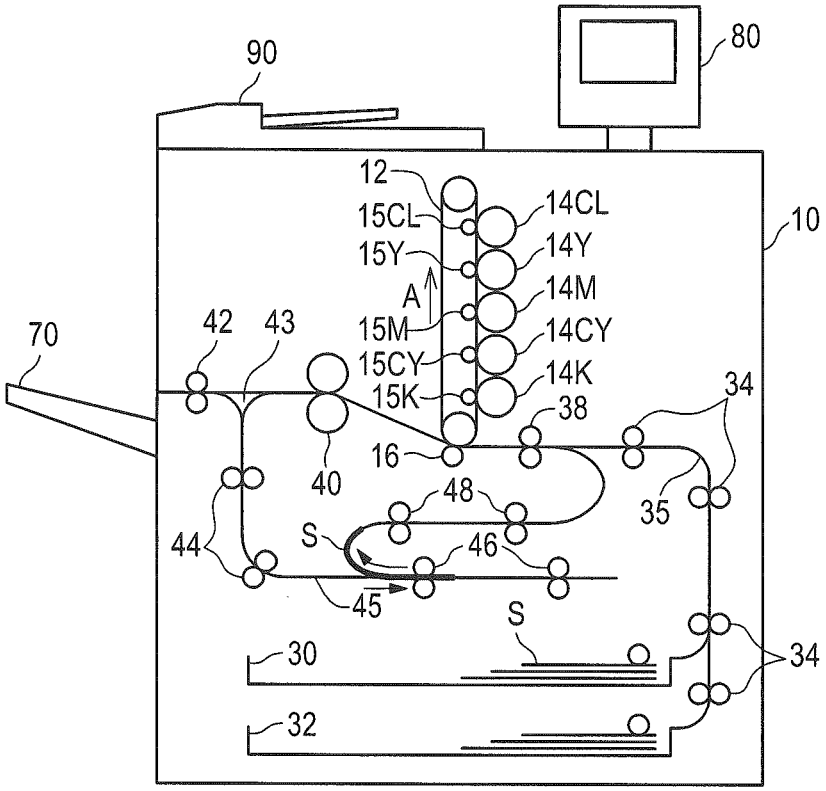
FIG. 5 illustrates sheet conveyance operation when printing is performed on both sides of a sheet in the image forming apparatus.

It should be noted that the image forming apparatus of the present embodiment has a double-sided printing mode which enables images to be printed on both sides of a sheet. FIG. 5 illustrates operation in the double-sided printing mode.

The sheet S loaded and accommodated in the paper feeding cassettes 30 and 32 is conveyed in a straight state to the secondary transfer roller 16 through the conveyance path 35 via the intermediate conveyance roller 34 and the resist roller 38 by control of the resist conveying unit 130. The toner image is transferred on one side of the sheet S at the secondary transfer roller 16 and fixed on the sheet S at the fixing unit 40.

The sheet S which has passed the fixing unit 40 is conveyed to a side of the conveyance reversing roller 44 by switching of the switching gate 43, and conveyed to an ADU reversing roller 46 which is driven to rotate normally, through the reverse conveyance path 45 by the conveyance reversing roller 44 which is driven to rotate normally. The sheet S which has been conveyed to the ADU reversing roller 46 is suspended at that position, and then conveyed to the ADU intermediate conveyance roller 48 by the ADU reversing roller 46 being driven to rotate reversely, and conveyed to the resist roller 38 by the ADU intermediate conveyance roller 48. At this time, the sheet S is reversed and conveyed to the resist roller 38 in a state where the sheet S is reversed front and back.

The sheet S which has been conveyed to the resist roller 38 is conveyed to the secondary transfer roller 16 by the conveyance path 35, and the toner image is transferred on the other side of the sheet S and fixed at the fixing unit 40. Subsequently, the sheet S is ejected to the paper ejection tray 70 through the paper ejection roller 42. At this time, it is possible to select whether to eject the sheet in a straight state or in a reversed state.

Figure 6:
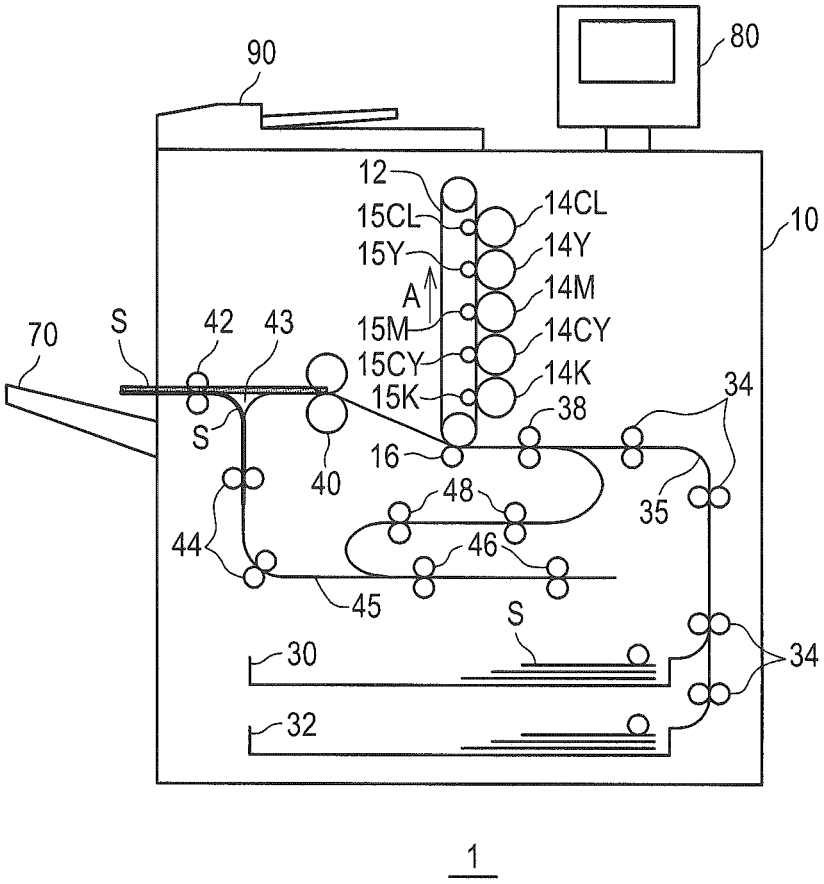
FIG. 6 illustrates operation when sheets are fed in an overlapped manner in the image forming apparatus.

Further, the image forming apparatus of the present embodiment can feed a previously printed sheet which is reversed and ejected by the reverse conveyance path 45 and a sheet which is ejected in a straight state by the conveyance path 35 in an overlapped manner. FIG. 6 illustrates a state where the sheets are fed in an overlapped manner.

The previously printed sheet for which an image has been previously formed and fixed is introduced inside the reverse conveyance path 45 by reverse paper ejection operation and ejected to a side of the paper ejection roller 42 by the conveyance reversing roller 44. Conveyance of the previously printed sheet is delayed by the sheet being reversed through the first conveyance route. Meanwhile, the subsequently printed sheet which has been printed subsequently catches up with the previously printed sheet which has been reversed and conveyed to the conveyance path 35, as is or by a conveyance timing being adjusted, and conveyed in a state where the subsequently printed sheet is overlapped on an upper face of the previously printed sheet, and ejected to the paper ejection tray 70.

It should be noted that the previously printed sheet and the subsequently printed sheet can be conveyed in a state where they entirely overlap with each other, or partly overlap with each other in a conveyance direction. When the sheets are conveyed in a state where they partly overlap with each other, an overlap area of the sheet is preferably 90% or more, which is advantageous in that the sheets can be easily aligned when being stacked.

Figure 7:
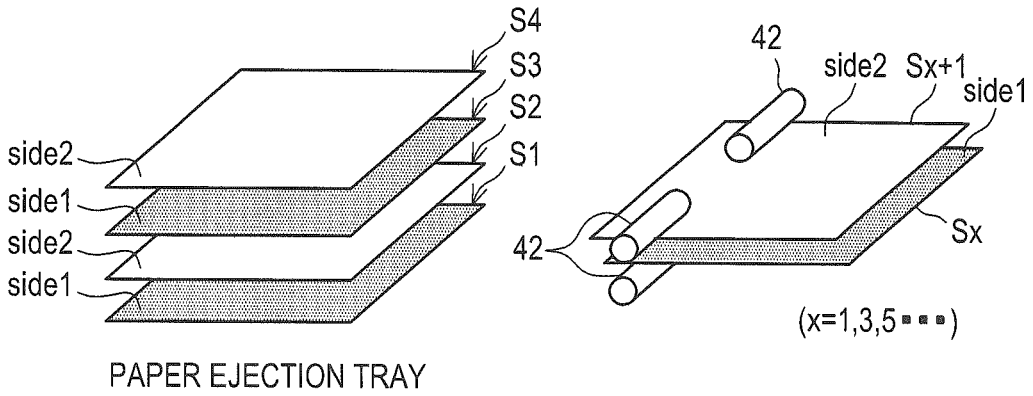
FIG. 7 illustrates a state where sheets are fed in an overlapped manner and a state where sheets are stacked in the image forming apparatus.

FIG. 7 illustrates a state where the previously printed sheet Sx overlaps with the subsequently printed sheet S(x+1) near the paper ejection roller 42, and the subsequently printed sheet S(x+1) is superimposed on the previously printed sheet Sx (where x is an odd number of 1, 3, 5, . . . ).

Because the previously printed sheet is reversed at the reverse conveyance path 45, an upper face of the previously printed sheet and a lower face of the subsequently printed sheet have the same charge polarity, so that a repulsive force is generated and it is possible to prevent the sheets from sticking to each other. In FIG. 7, the sheets fed in an overlapped manner face each other with sides 1.

Further, even if the sheets which are fed in an overlapped manner and superimposed on a stack unit and the paper ejection tray, are misaligned when being fed in an overlapped manner, it is possible to align the sheets by aligning the sheets at the stack unit which is not illustrated or the paper ejection tray.

Further, sets of the sheets fed in an overlapped manner have facing surfaces which have the same charge polarity. In FIG. 7, sets of the sheets face each other with sides 2. Therefore, it is possible to easily align the stacked sheets, so that it is possible to improve post-processing efficiency, and provide presentable ejected sheets on the paper ejection tray.

Further, by forming an image by reversing the order of a front side image and a back side image between the previously printed sheet and the subsequently printed sheet, it is possible to put the sheets in order of page numbers in a state where the sheets are fed in an overlapped manner. For example, by changing the order of images of the previously printed sheet between the front side and the back side, it is possible to put the sheets fed in an overlapped manner in order of page number.

Figure 8:
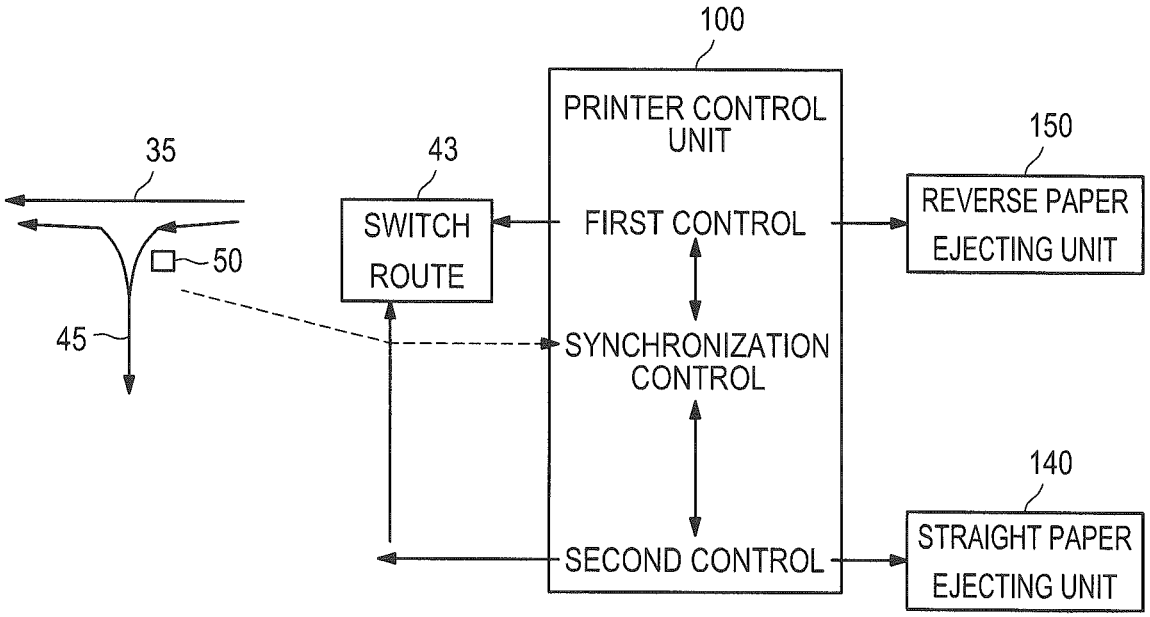
FIG. 8 describes control exerted when sheets are fed in the overlapped manner in the image forming apparatus.

FIG. 8 explains the first control and the second control.

When sheets are fed in an overlapped manner, at the printer control unit 100, the previously printed sheet is introduced to a side of the reverse conveyance path 45 by switching control of the switching gate 43 and control of the reverse ejecting unit 150, the sheet is reversed and ejected to a side of the conveyance path 35. Further, at the printer control unit 100, the subsequently printed sheet is ejected in a straight state on the conveyance path by switching control of the switching gate 43 and control of the straight paper ejecting unit 140. At this time, the subsequently printed sheet catches up with the previously printed sheet, so that it is possible to perform synchronization control of conveyance.

If the subsequently printed sheet cannot catch up with the previously printed sheet only by being ejected in a straight state, a sheet position detecting sensor 50 disposed near an entry of the reverse conveyance path 45 detects arrival of the previously printed sheet and notifies the printer control unit 100 of the arrival. The printer control unit 100 performs synchronization control by adjusting conveyance of the previously printed sheet and the subsequently printed sheet based on the detection result and an interval between the previously printed sheet and the subsequently printed sheet, or the like, thereby enabling conveyance of the previously printed sheet and the subsequently printed sheet in an overlapped manner after they meet. In the synchronization control, synchronization can be achieved by suspending and starting again conveyance of sheets or changing the conveyance speed. It should be noted that in the synchronization control, a state where sheets are misaligned to a certain degree can be made allowable in addition to a state where sheets completely overlap with each other.

Further, at the printer control unit 100, when a sheet is reversed at the reverse conveyance path 45, it is possible to reduce the conveyance speed of the sheet compared to a case where a sheet is reversed and conveyed at the reverse conveyance path 45 without being fed in an overlapped manner. When a sheet is reversed and conveyed at the reverse conveyance path 45 without overlapping with another sheet, there is a case where the conveyance speed is made higher than that for a sheet conveyed in the conveyance path 35 so as not to collide with a subsequent sheet. In this case, there is a case where it is not preferable to increase the conveyance speed because the weight of the sheet is light or the like. Therefore, by reducing the conveyance speed of the reverse conveyance path 45 when sheets are fed in an overlapped manner compared to normal conveyance, it is possible to reduce load on the sheet.

Figure 9:
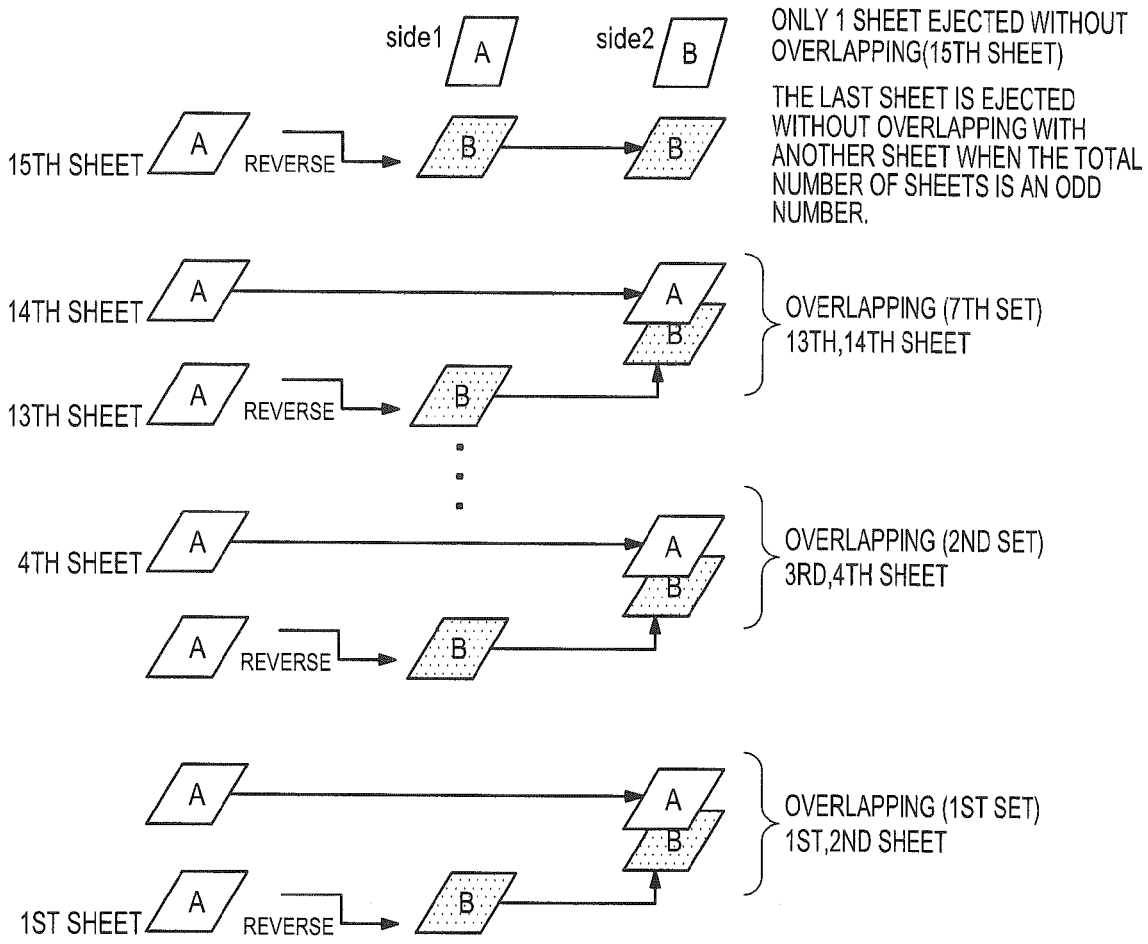
FIG. 9 illustrates a state where sheets are fed in an overlapped manner when the last page of the sheets of which the number of outputs sheet is an odd number is output in the image forming apparatus.

FIG. 9 illustrates an example where sheets are fed in an overlapped manner. FIG. 9 illustrates a first side of a sheet as a face A, and a second side of a sheet as face B.

The sheets are ejected with the same face (face A) up when ejected from the fixing unit, and, for the previously printed sheet, a front side and a back side are determined by reverse paper ejection (front side, face B). The subsequently printed sheet is ejected as is without being reversed (front side, face A). The sheets which are fed in an overlapped manner face each other with faces B which have the same charge polarity, so that it is possible to prevent the sheets from sticking to each other. By repeating the same state where sheets are fed in an overlapped manner for each of two sheets, each of two sheets are ejected in the same state with their faces facing each other. Further, sets of two sheets face each other with faces A.

Still further, in this job, because the number of sheets is an odd number, the last sheet is reversed and ejected without overlapping with another sheet.

By stacking sheets using the above-described method, it is possible to stack sheets while preventing the sheets from sticking to each other, and it is possible to easily align the sheets on the paper ejection tray. To stack sheets, there is a mechanism for aligning the sheets, so that it is possible to align the sheets.

While in the above-described example, because the number of sheets is an odd number, the last sheet is conveyed without overlapping with another sheet, when a plurality of sets each including a plurality of sheets are output, it is possible to convey sheets while a sheet of one set overlaps with a sheet of another set.

Figure 10:
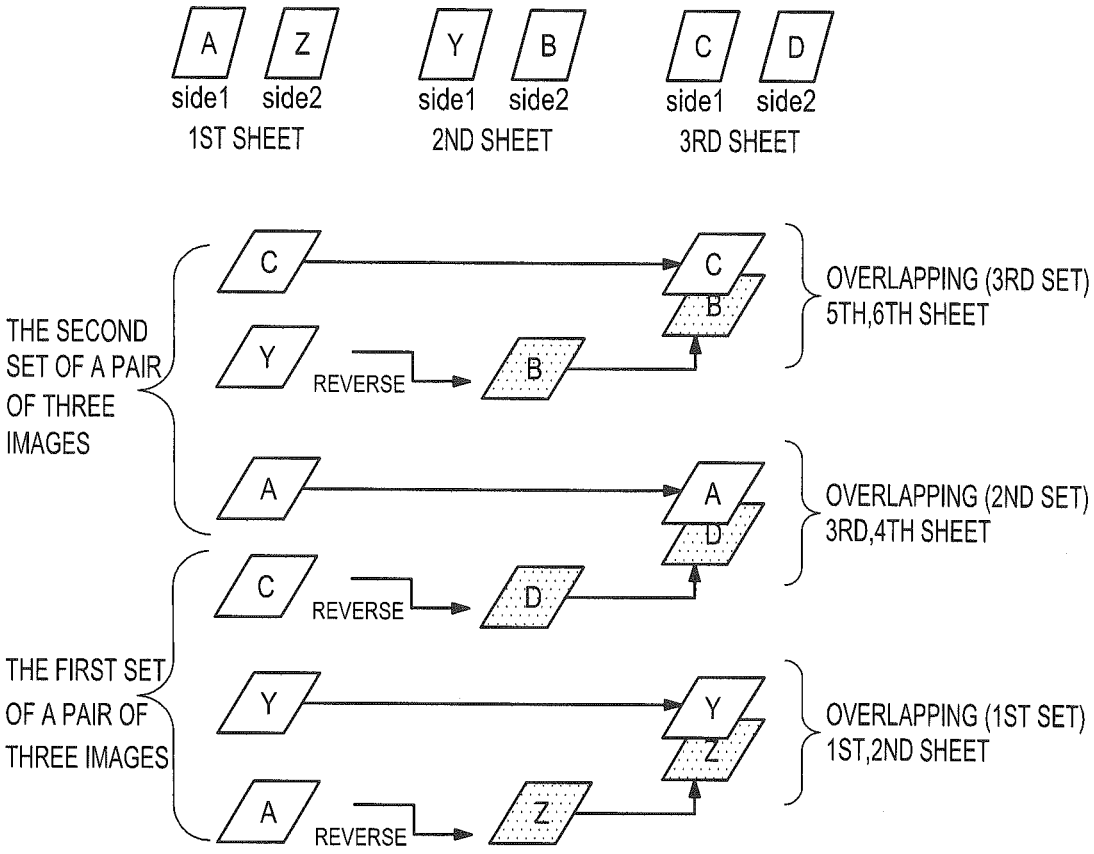
FIG. 10 illustrates a state where sheets are fed in an overlapped manner when a plurality of sets each including a plurality of sheets of images are output in the image forming apparatus.

FIG. 10 illustrates an example where three sets each including three sheets are output.

Sheets after being fixed are ejected with the same face up, and, in FIG. 10, the sheets are ejected with faces of first side up. In each conveyance, although the last page in each set is an odd page, it is possible to feed the sheets in an overlapped manner by combining the last page with the first page of the subsequent set. In each set fed in an overlapped manner, the sheets face each other with second sides, which have the same charge polarity, so that a repulsive force is generated, and it is possible to prevent the sheets from sticking to each other. Further, between sets fed in an overlapped manner, the sheets face each other with first sides, so that a repulsive force is generated, and it is possible to prevent the sheets from sticking to each other. If the last page of the whole sheets is an odd page, it is possible to reverse and convey the last page without overlapping with another sheet.

It should be noted that also in this embodiment, this processing is the same regardless whether a charging direction of a toner is positive or negative.

It should be noted that while in the above-described embodiment, an example has been described where the image forming apparatus has the first conveyance route and the second conveyance route and sheets are fed in an overlapped manner and ejected inside the image forming apparatus, in an image forming system in which a post-processing apparatus or the like is connected to the image forming apparatus, the first conveyance route and the second conveyance route can be provided in the post-processing apparatus, or the like, and sheets can be fed in an overlapped manner in the post-processing apparatus outside the image forming apparatus, or sheets fed in an overlapped manner can be fed in an overlapped manner to another post-processing apparatus without being ejected at the post-processing apparatus.

According to the embodiment described above, it is possible to reverse the previously printed sheet and convey the subsequently printed sheet in a straight state to eject the two sheets in an overlapped manner, and prevent the sheets from sticking to each other due to electrostatic adsorption between the sheets fed in an overlapped manner, so that it is possible to enable smooth post-processing process and the like. Further, it is possible to address a time loss due to reverse by feeding sheets in an overlapped manner, so that it is possible to provide an advantage of realizing output without degrading productivity.

While the present invention has been explained above based on the above-described embodiment, the present invention is not limited to the above-described embodiment, and can be naturally modified as appropriate without deviating from the scope of the present invention.

What is claimed is:

1. An image forming apparatus comprising:

an image forming unit that forms an image on a sheet;

a fixing unit structured to perform fixing of the sheet on which the image is formed;

ejection reverse conveyance unit structured to convey a sheet conveyed from the fixing unit such that the sheet is diverged from a route that extends to a sheet ejection from the fixing unit onto a reverse conveyance route, is reversed, and then is merged in the route that extends to the sheet ejection; and a control unit structured to perform first control of conveying a previously printed sheet, which is printed previously, via the reverse conveyance route of the reverse conveyance unit, perform second control of conveying a subsequently printed sheet, which is printed subsequently via the second conveyance route without being conveyed on the reverse conveyance route; and control conveyance of the previously printed sheet and the subsequently printed sheet such that the previously printed sheet and the subsequently printed sheet are fed in an overlapped manner in the route that extends to the sheet ejection at or after a merge location merging the reverse conveyance route and the route that extends to the sheet ejection;

wherein the control unit is structured to detect arrival of the previously printed sheet on the reverse conveyance route, and adjust conveyance of the previously printed sheet and the subsequently printed sheet on the basis of detection so that the previously printed sheet and the subsequently pointed sheet are led in the overlapped manner when the first conveyance route and the second conveyance route merge together.

2. The image forming apparatus according to claim 1, wherein the control unit is structured to perform the first control and the second control for sheets on both sides of which printing is performed.

3. The image forming apparatus according to claim 2, wherein the control unit is structured to exert control to form images on the sheets fed in the overlapped manner by the first control and the second control while a front side image and a back side image of one of the sheets are reversed from those of the other sheet.

4. The image forming apparatus according to claim 2, wherein the control unit is structured to exert control to convey a sheet solely in which printing is performed on one side by the first control or the second control.

5. The image forming apparatus according to claim 1, wherein the previously printed sheet and the subsequently printed sheet are conveyed while the previously printed sheet partly or completely overlaps with the subsequently printed sheet when the first conveyance route and the second conveyance route merge together.

6. The image forming apparatus according to claim 5, wherein the control unit is structured to exert control to feed the previously printed sheet and the subsequently printed sheet in the overlapped manner so that an overlap area of the sheets is 90% or more.

7. The image forming apparatus according to claim 5, wherein when the previously printed sheet and the subsequently printed sheet are conveyed while the previously printed sheet partly overlaps with the subsequently printed sheet, the previously printed sheet and the subsequently printed sheet are aligned in a stack unit or a paper ejecting unit.

8. The image forming apparatus according to claim 1, wherein the control unit is structured such that if number of output sheets is an odd number and when a last sheet is output, the control unit exerts control to convey the last sheet solely by performing the first control, without feeding the last sheet in the overlapped manner.

9. The image forming apparatus according to claim 1, wherein the control unit is structured to make a sheet linear speed in the reverse conveyance unit and set the sheet linear speed when the sheets are conveyed during the first control and the second control lower than a sheet linear speed when the sheets are conveyed only during the first control.

10. The image forming apparatus according to claim 1, wherein the control unit is structured to exert control to feed the sheets in the overlapped manner so that sides of the sheets facing each other are charged with same polarity.

11. An image forming system comprising:

an image forming unit that forms an image on a sheet;

a fixing unit that performs fixing of the sheet on which the image is formed;

ejection reverse conveyance unit structured to convey a sheet from the fixing unit such that the sheet is diverged from the route that extends to a sheet ejection from the fixing unit onto a reverse conveyance route, is reversed, and then is merged in the route that extends to the sheet ejection; and a control unit that structured to perform first control of conveying a previously printed sheet, which is printed previously via the reverse conveyance route of the reverse conveyance unit; perform second control of conveying a subsequently printed sheet, which is printed subsequently without being conveyed on the reverse conveyance route; and control conveyance of the previously printed sheet and the subsequently printed sheet such that the previously printed sheet and the subsequently printed sheet are fed in an overlapped manner in the route that extends to the sheet ejection at or after a merge location merging the reverse conveyance route and the route that extends to the sheet ejection;

wherein the control unit is structured to detect arrival of the previously printed sheet on the revere conveyance route, and adjust conveyance of the previously printed sheet and the subsequently printed sheet on the basis of detection so that the previously printed sheet and the subsequently printed sheet are fed in the overlapped manner when the first conveyance route and the second conveyance route merge together.

12. The image forming system according to claim 11, wherein the control unit is structured to perform the first control and the second control for sheets on both sides of which printing is performed.

13. The image forming system according to claim 12, wherein the control unit is structured to exert control to form images on the sheets fed in the overlapped manner by the first control and the second control while a front side image and a back side image of one of the sheets are reversed from those of the other sheet.

14. The image forming system according to claim 12, wherein the control unit is structured to exert control to convey a sheet solely in which printing is performed on one side by the first control or the second control.

15. The image forming system according to claim 11, wherein the previously printed sheet and the subsequently printed sheet are conveyed while the previously printed sheet partly or completely overlaps with the subsequently printed sheet when the first conveyance route and the second conveyance route merge together.

16. The image forming system according to claim 15, wherein the control unit is structured to exert control to feed the previously printed sheet and the subsequently printed sheet in the overlapped manner so that an overlap area of the sheets is 90% or more.

17. The image forming system according to claim 15, wherein when the previously printed sheet and the subsequently printed sheet are conveyed while the previously printed sheet partly overlaps with the subsequently printed sheet, the previously printed sheet and the subsequently printed sheet are aligned in a stack unit or a paper ejection tray.

18. The image forming system according to claim 11, wherein the control unit is structured such that if number of output sheets is an odd number and when a last sheet is output, the control unit exerts control to convey the last sheet solely by performing the first control, without feeding the last sheet in the overlapped manner.

19. The image forming system according to claim 11, wherein the control unit is structured to make a sheet linear speed in the reverse conveyance unit variable and set the sheet linear speed when the sheets are conveyed during the first control and the second control lower than a sheet linear speed when the sheets are conveyed only during the first control.

20. The image forming system according to claim 11, wherein the control unit is structured to exert control to feed the sheets in the overlapped manner so that sides of the sheets facing each other are charged with same charge polarity.

21. The image forming system according to claim 11, wherein the control unit is structured to detect arrival of the previously printed sheet on the reverse conveyance route, and adjust conveyance of the previously printed sheet and the subsequently printed sheet on the basis of the detection so that the previously printed sheet and the subsequently printed sheet are fed in the overlapped manner when the first conveyance route and the second conveyance route merge together.

22. An image forming method for forming an image on a sheet and conveying the sheet, the method comprising:

conveying a previously printed sheet which is printed previously via a reverse conveyance route of a reverse conveyance unit;

conveying a subsequently printed sheet which is printed subsequently without being conveyed on the reverse conveyance route; and feeding the previously printed sheet and the subsequently printed sheet such that the previously printed sheet and the subsequently printed sheet are fed in an overlapped manner in the route that extends to the sheet ejection at or after a merge location merging the reverse conveyance route and the route that extends to the sheet ejection;

wherein, when arrival of the previously printed sheet on the reverse conveyance route is detected, conveyance of the previously printed sheet and the subsequently printed sheet is adjusted on the basis of detection so that the previously printed sheet and the subsequently printed sheet are fed in the overlapped manner when the first conveyance route and the second conveyance route merge together.

* * * * *